US009022624B2

(12) United States Patent
Abe

(10) Patent No.: US 9,022,624 B2
(45) Date of Patent: May 5, 2015

(54) VEHICLE HEADLAMP

(75) Inventor: Toshiya Abe, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 275 days.

(21) Appl. No.: 13/569,795

(22) Filed: Aug. 8, 2012

(65) Prior Publication Data

US 2013/0039084 A1 Feb. 14, 2013

(30) Foreign Application Priority Data

Aug. 10, 2011 (JP) ..... 2011-175387
Aug. 10, 2011 (JP) ..... 2011-175388
Aug. 10, 2011 (JP) ..... 2011-175389

(51) Int. Cl.
*F21V 7/00* (2006.01)
*F21S 8/10* (2006.01)

(52) U.S. Cl.
CPC ..... *F21S 48/1159* (2013.01); *F21S 48/1757* (2013.01)

(58) Field of Classification Search
CPC ..... F21S 48/1757; F21S 48/1794
USPC ..... 362/512–515
See application file for complete search history.

(56) References Cited

U.S. PATENT DOCUMENTS

2009/0109697 A1* 4/2009 Kim et al. ..... 362/512
2010/0110710 A1 5/2010 Abe

FOREIGN PATENT DOCUMENTS

JP 2010-108777 A 5/2010

* cited by examiner

*Primary Examiner* — Sean Gramling
(74) *Attorney, Agent, or Firm* — Foley & Lardner LLP

(57) ABSTRACT

The present invention provides: semiconductor-type light sources; a fixed reflector having reflection surfaces; movable reflectors having reflection surfaces; a solenoid; and a driving force transmission mechanism. The driving force transmission mechanism is made of: a rack that is elastically deformable; and pinions. A height H1 of a respective one of gear portions at each end part of the rack is greater in comparison with a height H2 of a respective one of gear portions at an intermediate part of the rack. As a result, the present invention is capable of maintaining a load between the rack and a respective one of the pinions at its required minimum level, and is capable of maintaining positional precision in stop location of the movable reflectors at high precision.

8 Claims, 13 Drawing Sheets

(A)

(B)

(C)

VEHICLE HEADLAMP

CROSS-REFERENCE TO RELATED APPLICATIONS

This application claims priority of Japanese Patent Application No. 2011-175387, Japanese Patent Application No. 2011-175388 and Japanese Patent Application No. 2011-175389 filed on Aug. 10, 2011. The contents of these applications are incorporated herein by reference in their entirety.

BACKGROUND OF THE INVENTION

1. Field of the Invention

The present invention relates to a vehicle headlamp for switching at least a first light distribution pattern, for example, a light distribution pattern for low beam (a light distribution pattern for passing) and a second light distribution pattern, for example, a light distribution pattern (a light distribution pattern for cruising) from each other to emit light forward of a vehicle.

2. Description of the Related Art

A vehicle headlamp of such type is conventionally known (for example, Japanese Unexamined Patent Application Publication No. 2010-108777). Hereinafter, a conventional vehicle headlamp will be described. The conventional vehicle headlamp is provided with a semiconductor-type light source, a fixed reflector, a movable reflector, a driving source, and a driving force transmission mechanism made of a rack and a pinion. Hereinafter, functions of the conventional headlamp will be described. When the movable reflector is positioned in a first location, if the semiconductor-type light source is lit, a light distribution pattern for low beam is obtained. When the movable reflector is positioned in a second location via the driving source and the driving force transmission mechanism, a light distribution pattern for high beam is obtained. In such a vehicle headlamp, it is important to maintain a load between the rack and the pinion of the driving force transmission mechanism at its required minimum level and to maintain the related positional precision in stop location (between the first location and the second location) of the movable reflector with high precision.

However, in the conventional vehicle headlamp, if a backlash between the rack and the pinion is set to "0", the related positional precision is maintained at high precision due to influence of thermal expansion and shrinkage of the rack and the pinion, whereas the load between the rack and the pinion increases due to the thermal expansion. On the other hand, if the backlash between the rack and the pinion is set to be large, the load between the rack and the pinion can be maintained at its required minimum level, whereas the backlash further increases due to thermal shrinkage and then the related positional precision lowers.

In addition, in the conventional headlamp, it is important to ensure that an engagement state (condition) between the rack and the pinion of the driving force transmission mechanism is stabilized.

However, in the conventional vehicle headlamp, the rack rotates around a fixed center with respect to the driving source due to a vibration or actuation load at the time of, or subsequent to, assembling of the rack and the pinion of the driving force transmission mechanism, and then, the engagement state (condition) between a flat gear portion of the rack and a circular gear portion of the pinion may become unstable. In this case, a workload between the rack and the pinion of the driving force transmission mechanism increases, and there is a need to increase the driving source in size, or alternatively, there is a need to provide a mechanism for preventing the rotation of the rack. Due to an increase in size of the driving source or due to an increased number of parts such as the mechanism for preventing the rotation of the rack, its related manufacturing costs tends to become higher or its related mass or power consumption tends to increase.

SUMMARY OF THE INVENTION

The present invention has been made in order to the problem described above, and it is an object of the present invention to provide a vehicle headlamp that is capable of maintaining a load between a rack and a pinion of a driving force transmission mechanism at its required minimum level and that is capable of maintaining the related positional precision in stop location of a movable reflector, and further, that is capable of stabilizing an engagement state (condition) between the rack and the pinion of the driving force transmission mechanism.

In a first aspect of the present invention, a vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is adapted to reflect light from the semiconductor-type light source;

a movable reflector having a reflection surface that is adapted to reflect the light from the semiconductor-type light source, the movable reflector being rotatably disposed at least between a first location and a second location;

a driving source; and a driving force transmission mechanism that is provided between the driving source and the movable reflector, and is adapted to transmit a driving force of the driving source to the movable reflector to thereby transfer the movable reflector at least between the first location and the second location, wherein the driving force transmission mechanism is made of a rack having an elastically deformable structure and a pinion engaging with the rack.

In a second aspect of the present invention, the vehicle headlamp according to the first aspect, wherein the rack is a rack having an elastically deformable structure in which a slit that is in parallel to a pitch line is provided, and which is elastically deformable in a direction crossing the slit.

In a third aspect of the present invention, the vehicle headlamp according to the first aspect, wherein the rack is a rack having an elastically deformable structure which is made of a plate member, and is elastically deformable in a direction crossing the plate member.

In a fourth aspect of the present invention, a vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is adapted to reflect light from the semiconductor-type light source;

a movable reflector having a reflection surface that is adapted to reflect the light from the semiconductor-type light source, the movable reflector being rotatably disposed at least between a first location and a second location;

a driving source; and a driving force transmission mechanism that is provided between the driving source and the movable reflector, and is adapted to transmit a driving force of the driving source to the movable reflector to thereby transfer the movable reflector at least between the first location and the second location, wherein the driving force transmission mechanism is made of a rack having an elastically deformable structure and a pinion engaging with the rack, and a height of at least one of a gear portion of the rack and a gear portion of the pinion when the movable reflector is positioned in at least a stop location between a first location and a second location is greater in comparison with a height of at least one of a gear portion of the rack and a gear portion of the pinion when the movable reflector is positioned in a location other than the stop location between the first location and the second location.

In a fifth aspect of the present invention, the vehicle headlamp according to the fourth aspect, wherein a height of a gear portion at each end part of the rack is greater in comparison with a height of a gear portion at an intermediate part of the rack, a first location in which the movable reflector stops is a location in which the pinion engages with a gear portion at one end part of the rack, and a second location in which the movable reflector is a location in which the pinion engages with a gear portion at the other end part of the rack.

In a sixth aspect of the present invention, the vehicle headlamp according to the fourth aspect, wherein the first location in which the movable reflector stops is a location in which the pinion engages with the gear portion at one end part of the rack, the second location in which the movable reflector is a location in which the pinion engages with the gear portion at the other end part of the rack, and among the gear portions of the pinion, a height of the gear portion engaging with the gear portion at one end part of the rack and the gear portion engaging with the gear portion at the other end part of the rack is greater than a height of the gear portion engaging with the gear portion at the intermediate part of the rack.

In a seventh aspect of the present invention, a vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is adapted to reflect light from the semiconductor-type light source;

a movable reflector having a reflection surface that is adapted to reflect the light from the semiconductor-type light source, the movable reflector being rotatably disposed at least between a first location and a second location;

a driving source; and a driving force transmission mechanism that is provided between the driving source and the movable reflector, and is adapted to transmit a driving force of the driving source to the movable reflector to thereby transfer the movable reflector at least between the first location and the second location, wherein the driving force transmission mechanism is made of a rack that is fixed to the driving source and a pinion that is fixed to the movable reflector, and that is adapted to engage with the rack, and a gear portion of the rack, with which the pinion engages, is formed in a shape of an arc that is a part of a circle around a fixed center with respect to the driving source of the rack.

In a eighth aspect of the present invention, a vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is adapted to reflect light from the semiconductor-type light source;

a movable reflector having a reflection surface that is adapted to reflect the light from the semiconductor-type light source, the movable reflector being rotatably disposed at least between a first location and a second location;

a driving source; and a driving force transmission mechanism that is provided between the driving source and the movable reflector, and is adapted to transmit a driving force of the driving source to the movable reflector to thereby transfer the movable reflector at least between the first location and the second location, wherein the driving force transmission mechanism is made of a rack that is fixed to the driving source and a pinion that is fixed to the movable reflector, and that is adapted to engage with the rack, and a gear portion of the rack, with which the pinion engages, is formed in a circular shape around a fixed center with respect to the driving source of the rack.

In a vehicle headlamp according to a first aspect of the present invention, a rack is a rack that is structured to be elastically deformable; and therefore, an influence of thermal expansion or shrinkage of the rack and a pinion can be absorbed, and as a result, a load between the rack and the pinion of a driving force transmission mechanism can be maintained at its required minimum level, and the related positional precision in stop location of a movable reflector can be maintained at high precision. In other words, in a state in which a backlash (a play or a gap) is set to "0", if the rack and the pinion thermally expand and then a load between the rack and the pinion increases, in order to absorb an influence due to such an increased load, the rack is elastically deformed to thereby absorb an influence due to thermal expansion and then the load between the rack and the pinion can be maintained at its required minimum level. In this manner, downsizing of a driving source or reduction of costs, mass, or power consumption can be achieved. On the other hand, if the rack and the pinion thermal shrink and then the backlash between the rack and the pinion increases, in order to absorb an influence due to an increase in such backlash, the rack is elastically deformed to thereby absorb an influence of thermal shrinkage; and therefore, the backlash can be set in a state of "0" and then the related positional precision can be maintained at high precision. In this manner, the vehicle headlamp according to the first aspect of the present invention is capable of maintaining the load between the rack and the pinion of the driving force transmission mechanism at its required minimum level, thus making it possible to perform switching between a light distribution pattern for load beam and a light distribution pattern for high beam smoothly and within a short period of time. Moreover, the related positional precision in stop location of a movable reflector can be maintained at high precision, thus making it possible to improve light distribution precision of the light distribution pattern for low beam and the light distribution pattern for high beam or the like in comparison with that of the conventional technique. Furthermore, there is no need to selectively employ an expensive material with its comparatively low linear expansion coefficient (thermal expandability) as a material for the rack and the pinion of the driving force transmission mechanism, and its related manufacturing costs can be reduced accordingly.

In a vehicle headlamp according to a second aspect of the present invention, a slit which is (substantially) in parallel to a pitch line is provided in a rack; and therefore, its related structure is simplified. Moreover, the rack is reliably elastically deformable in response to thermal expansion or shrinkage; and therefore, thermal expansion or shrinkage can be reliably absorbed, a load between the rack and a pinion of a driving force transmission mechanism can be maintained at its required minimum level, and the related positional precision can be maintained at high precision.

In a vehicle headlamp according to a third aspect of the present invention, a rack is made of a plate member, and is elastically deformed in a direction crossing the plate member; and therefore, its related structure is simplified. Moreover, the rack is reliably elastically deformable in response to thermal expansion or shrinkage, thermal expansion or shrinkage can be reliably absorbed, a load between the rack and the pinion of the driving force transmission mechanism can be maintained at its required minimum level, and the related positional precision can be maintained at high precision.

In a vehicle headlamp according to a fourth aspect of the present invention, when a movable reflector is positioned in at least a stop location between a first location and a second location, a gear portion with its greater height, of at least either a gear portion of a rack or a gear portion of a pinion is geared therewith, and when the movable reflector is positioned at least in a location other than the stop location between the first location and the second location (in other words, when the movable reflector rotationally moves at beast between the first location and the second location), a gear portion with its smaller height, of at least either a gear portion of a rack or a gear portion of a pinion, is geared therewith. As a result, a load between the rack and the pinion of the driving force transmission mechanism can be maintained at its required minimum level, and the related positional precision in stop location of the movable reflector can be maintained at high precision. In other words, in a state in which a backlash (a play or a gap) between the pinion and the gear portion with its greater height is set to "0", even if the rack and the pinion thermally expand, a load between the pinion and the gear portion with its smaller height can be maintained at its required minimum level. In this manner, downsizing of a driving source or reduction of costs, mass, or power consumption can be achieved. On the other hand, in a state in which a backlash is provided between the pinion and the gear portion with its smaller height, even if the rack and the pinion thermally shrink, a backlash between the pinion and the gear portion with its greater height can be maintained in a state of "0" or in a state close to "0", and the related positional precision can be maintained at high precision. In this manner, the vehicle headlamp according to the first aspect of the present invention is capable of maintaining a load between the rack and the pinion of the driving force transmission mechanism at its required minimum level, thus making it possible to perform switching between a light distribution pattern for low beam and a light distribution pattern for high beam smoothly and within a short period of time. Moreover, the related positional precision in stop location of a movable reflector can be maintained at high precision, thus making it possible to improve light distribution precision of the light distribution pattern for low beam and the light distribution pattern for high beam or the like in comparison with that of the conventional technique. Furthermore, there is no need to selectively employ an expensive material with its comparatively low linear expansion coefficient (thermal expandability) as a material for the rack and the pinion of the driving force transmission mechanism, and its related manufacturing costs can be reduced accordingly.

In a vehicle headlamp according to a fifth aspect of the present invention, when a movable reflector is positioned in a stop location as a first location, a pinion engages with a gear portion that is greater in height at one end part of a rack, when the movable reflector is positioned in a stop location as a second location, the pinion engages with a gear portion that is greater in height at the other end part of the rack, and when the movable reflector is positioned in a location other than the stop location between the first location and the second location, the pinion engages with a gear portion that is smaller in height of an intermediate part of the rack. As a result, a load between the rack and the pinion of the driving force transmission mechanism can be maintained at its required minimum level, and the related positional precision in stop location between the first location and the second location of the movable reflector can be maintained at high precision.

In a vehicle headlamp according to a sixth aspect of the present invention, when a movable reflector is positioned in a first location, a gear portion that is greater in pinion height engages with a gear portion that is greater in height at one end part of a rack, when the movable reflector is positioned in a stop location as a second location, the gear portion that is greater in pinion height engages with a gear portion that is greater in height at the other end part of the rack, and when the movable reflector is positioned in a location other than the stop location between the first location and the second location, a gear portion that is smaller in pinion height engages with a gear portion that is smaller in height at an intermediate part of the rack. As a result, a load between the rack and the pinion of the driving force transmission mechanism can be maintained at its required minimum level, and the related positional precision in stop location between the first location and the second location of the movable reflector can be maintained at high precision.

In a vehicle headlamp according to a respective one of a seventh aspect and an eighth aspect of the present invention, a gear portion of a rack, with which a pinion is to be geared, is formed in an arc shape as a part of a circle around a fixed center with respect to a driving source of the rack, or alternatively, in a circular shape. As a result, even in a case where the rack rotates around the fixed center with respect to the driving source due to a vibration or actuation load at the time of, or subsequent to, assembling of the rack and the pinion of the driving force transmission mechanism, an engagement state (condition) between a gear portion in the arc shape of the rack or a gear portion in the circular shape and a circular gear portion of the pinion is stabilized. Thus, there is no need to upsize a driving source due to an increase in actuation load between the rack and the pinion of the driving force transmission mechanism, or alternatively, there is no need to provide a mechanism for preventing the rotation of the rack; and therefore, its related manufacturing costs, mass, or power consumption can be restrained at its required minimum level.

DESCRIPTION OF THE PREFERRED EMBODIMENTS

Figure 1:
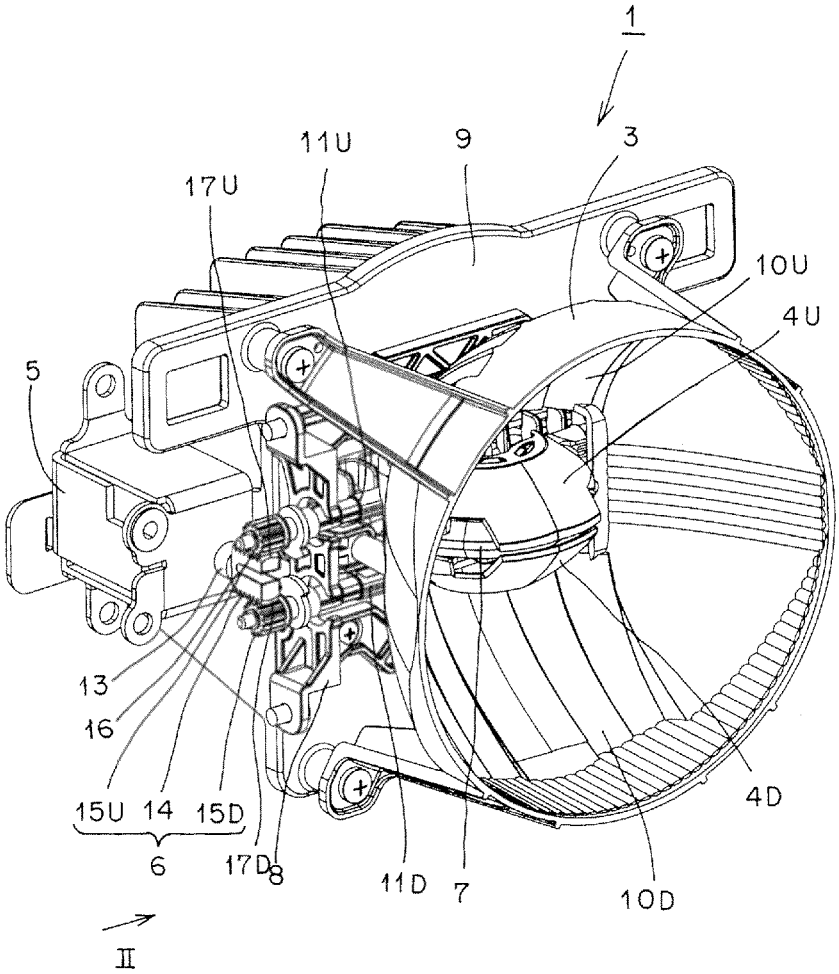
FIG. 1 is a perspective view showing a lamp unit of a vehicle headlamp according to a first embodiment of the present invention.
Figure 2:
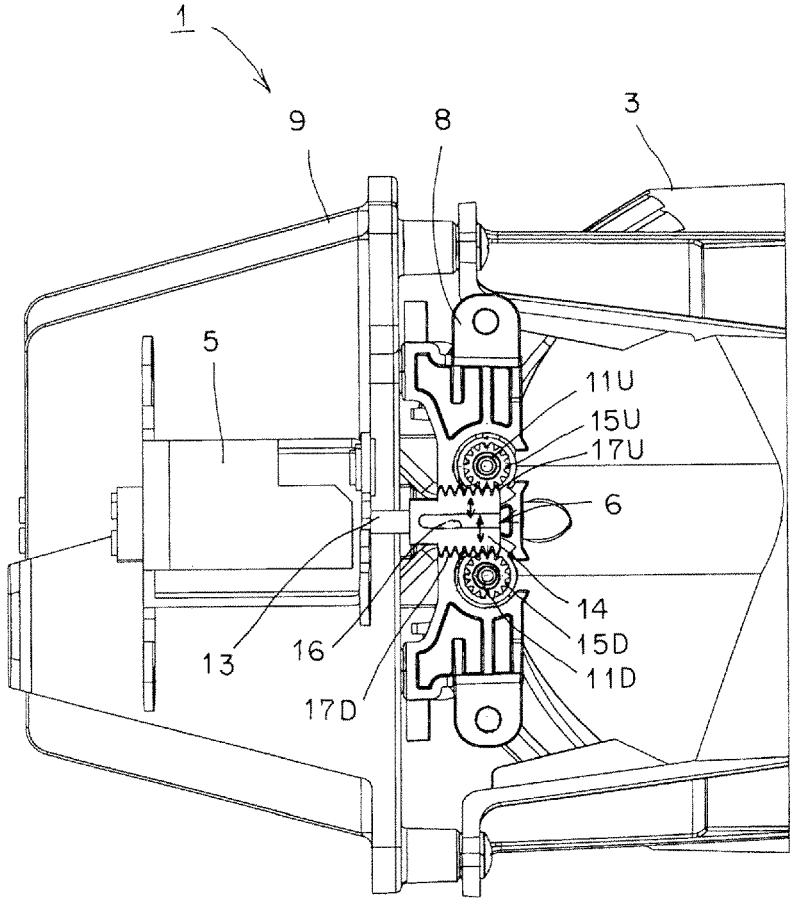
FIG. 2 is a view taken along the direction as indicated by the arrow II in FIG. 1 (a side view of the lamp unit)

Hereinafter, the preferred embodiments of a vehicle headlamp according to the present invention will be described in detail with reference to the drawings. It is to be noted that the present invention is not limited by the embodiments. In the drawings, a combination of uppercase letters with hyphen "VU-VD" designates a vertical line from the top to the bottom of a screen. A combination of uppercase letters with hyphen "HL-HR" designates a horizontal line from the left to the right of the screen. It is also to be noted that in the present specification and claims, the terms "upside, downsize, foreside, backside, left and right" designates the "upside, downside, foreside, backside, left, and right" of a vehicle when the vehicle headlamp according to the present invention is mounted on a vehicle (an automobile).

Description of Configuration of First Embodiment

FIG. 1 to FIG. 9 each show a vehicle headlamp according to a first embodiment of the present invention. Hereinafter, a configuration of the vehicle headlamp in the first embodiment will be described. In the figures, reference numeral 1 designates a vehicle headlamp (an automotive headlamp) in the first embodiment. The vehicle headlamp 1 is adapted to switch a light distribution pattern for low beam (a light distribution pattern for passing) LP shown in FIG. 8 and a light distribution pattern for high beam (a light distribution pattern for cruising) shown in FIG. 9 from each other to emit light forward of a vehicle. The light distribution pattern for low beam LP has an oblique cutoff line CL1 on a cruising lane side (left side) and has a horizontal cutoff line CL2 on an opposite lane side (right side), around an elbow point E. An angle formed by the oblique cutoff line CL1 and the horizontal line HL-HR of the screen is about 15 degrees. The light distribution pattern for high beam has: a first light distribution pattern for high beam HP1; a second light distribution pattern for high beam HP2; a third light distribution pattern for high beam HP3; and a dimmed light distribution pattern for low beam LP1.

As shown in FIG. 1 to FIG. 4, the vehicle headlamp 1 is made of: an upside semiconductor-type light source 2U and a lower semiconductor-type light source 2D; a fixed reflector 3; an upside movable reflector 4U and a downside movable reflector 4D; a solenoid 5 serving as a driving source; a driving force transmission mechanism 6; a light source mount member (an LED base) 7; a mount bracket 8; a heat sink member 9; and a lamp housing and a lamp lens (such as a transparent outer lens, for example), although not shown.

A lamp unit is configured with the upside semiconductor-type light source 2U and the lower semiconductor-type light source 2D; the fixed reflector 3; the upside movable reflector 4U and the downside movable reflector 4D; the solenoid 5; the driving force transmission mechanism 6; the light source mount member 7; the mount bracket 8; and the heat sink member 9. The constituent elements 2U, 2D, 3, 4U, 4D, 5, 6, 7, 8, and 9 of the lamp unit are disposed in a lamp room that is defined by the lamp housing and the lamp lens, for example, via an optical axis adjustment mechanism (not shown). It is to be noted that in the lamp room, in addition to the constituent elements 2U, 2D, 3, 4U, 4D, 5, 6, 7, 8, and 9 of the lamp unit, there may be disposed another lamp such as a fog lamp, a cornering lamp, a clearance lamp, or a turning signal lamp.

The light source mount member 7 and the mount bracket 8 are fixed in a state in which these members are respectively positioned in their predetermined locations in the heat sink member 9. The heat sink member 9 is mounted on the lamp housing via the optical axis adjustment mechanism.

The semiconductor-type light source 2U and 2D are self-light semiconductor-type light source such as an LED or an EL (an organic EL), for example, in other words, are semiconductor-type light sources. In the embodiment, an LED is used. The upside semiconductor-type light source 2U and the downside semiconductor-type light source 2D are respectively mounted on top and bottom mount surfaces of the light source mount member 7.

The fixed reflector 3 is fixed to the heat sink 9. The fixed reflector 3 has an upside reflection surface 10U and a downside reflection surface 10D, a respective one of which is made of a parabolic free curved surface (a NURBS-curved surface). The upside reflection surface 10U serves to reflect light from the upside semiconductor-type light source 2U. The downside reflection surface 10D serves to reflect light from the downside semiconductor-type light source 2D.

On both of the left and right sides of the upside movable reflector 4U and the downside movable reflector 4D, an upper rotary shaft 11U and a lower rotary shaft 11D are respectively integrally provided transversely and horizontally. The rotary shafts 11U and 11D are rotatably mounted on the mount bracket 8. As a result, the upside movable reflector 4U and the downside movable reflector 4D are rotatably mounted on the mount bracket 8 between a first location (the location shown in FIG. 1 and FIG. 3) and a second location (the location shown in FIG. 4). It is to be noted that at the upside movable reflector 4U and the downside movable reflector 4D, there may be provided a spring (not shown) adapted to automatically restore the upside movable reflector 4U and the downside movable reflector 4D from the second location to the first location.

The upside movable reflector 4U and the downside movable reflector 4D have an upper reflection surface 12U and a downside reflection surface 12D, a respective one of which is made of a parabolic free curved surface (a NURBS-curved surface). The upside reflection surface 12U serves to reflect light from the upside semiconductor-type light source 2U. The downside reflection surface 12D serves to reflect light from the downside semiconductor-type light source 2D.

The solenoid 5 is fixed to the heat sink member 9. The solenoid 5 has a plunger (an advancing/retracting rod) 13. The plunger 13 is positioned in a first location (a retracting location shown in FIG. 1 to FIG. 3) when no power is supplied to the solenoid 5, and is positioned in a second location (an advancing location shown in FIG. 4) when power is supplied to the solenoid 5. At the solenoid 5, a spring (not shown) adapted to automatically restore the plunger 13 from the second location to the first location is provided.

The driving force transmission mechanism 6 is provided between: a respective one of the rotary shafts 11U and 11D of the upside movable reflector 4U and the downside movable reflector 4D; and the plunger 13 of the solenoid 5. The driving force transmission mechanism 6 serves to transmit a driving force of the solenoid 5 to the upside movable reflector 4U and the downside movable reflector 4D, thereby transferring the upside movable reflector 4U and the downside movable reflector 4D between the first location and the second location.

The driving force transmission mechanism 6 is made of a rack 14, an upside pinion 15U and a downside pinion 15D to be engaged with the rack 14 from the top and the bottom. The rack 14 is fixed to one end (a tip end) of the plunger 13. The upside pinion 15U and the downside pinion 15D are respectively fixed to one ends of the upside reflection surface 10U and the downside reflection surface 10D. The driving force transmission mechanism 6 is a mechanism adapted to convert a linear motion of the rack 14 to rotational motions of the upside pinion 15U and the downside pinion 15D.

The rack 14 is made of a metal member in this example. On the top and bottom of the rack 14, an upside gear portion 17U and a downside gear portion 17D are respectively provided, and a flat chamfer is provided on a respective one of the left and right sides. The upside gear portion 17U and the downside gear portion 17D are formed in the shape of an arc that is a part of a circle around a center O around which the rack 14 is fixed to the plunger 13 of the solenoid 5 (the fixed center with respect to the solenoid 5 of the rack 14). It is to be noted that the upside gear portion 17U and the downside gear portion 17D may be formed in a flat shape. The upside pinion 15U and the downside pinion 15D are respectively engaged with the upside gear portion 17U and the downside gear portion 17D of the rack 14.

A slit 16 that is (substantially) in parallel to a pitch line (a pitch line of top and bottom circular gear portions) is provided at an intermediate part between the upside gear portion 17U and the downside gear portion 17D of the rack 14. The rack 14 is a rack with its elastically deformable structure in which the upside gear portion 17U and the downside gear portion 17D cross the slit 16 (in the direction indicated by the arrow drawn by solid line in FIG. 2 and FIG. 3).

A width of the slid 16 (a width in a vertical direction) is of size to an extent such that the rack is elastically deformed faithfully following a force acting on the upside gear portion 17U and the downside gear portion 17D. The slit 16 opens in an end part opposite to an end part on a side on which the plunger 13 of the rack 14 is fixed.

Figure 5:
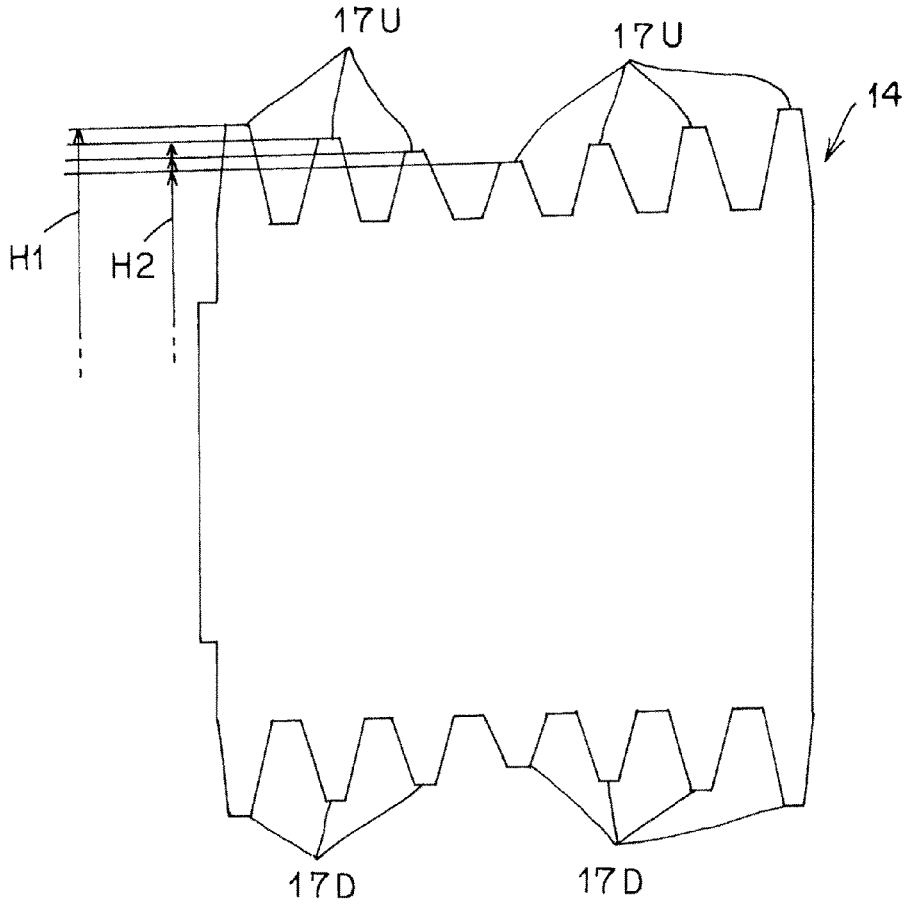
FIG. 5 is an enlarged side view showing a rack.
Figure 6:
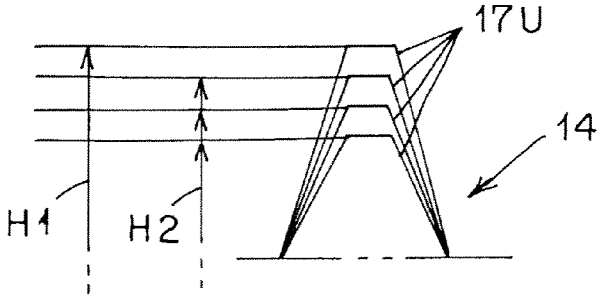
FIG. 6 is an explanatory view showing levelness in height of gear portions of the rack.
Figure 7:
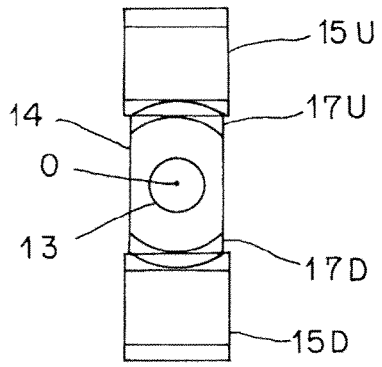
FIG. 7 is an explanatory view showing an engagement state between the gear portion of the rack and a gear portion of a pinion.
Figure 7:
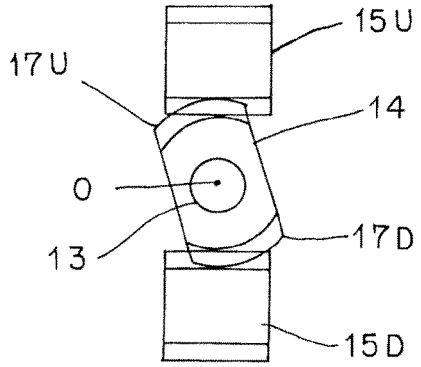
Figure 7:
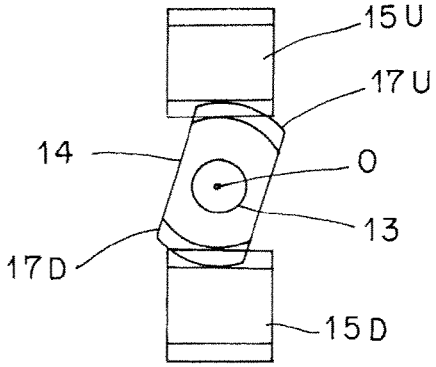
Figure 8:
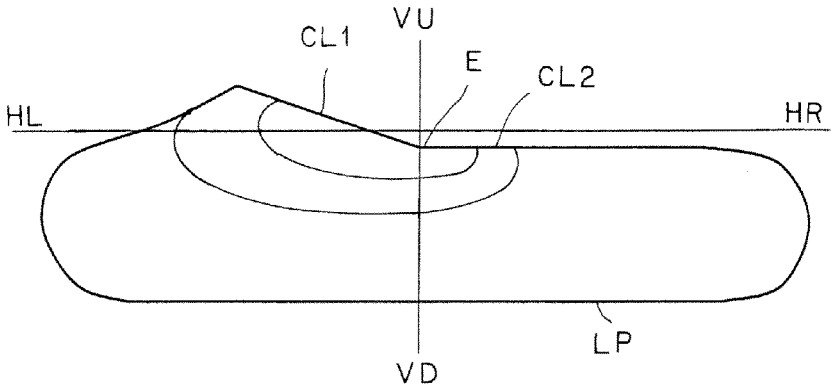
FIG. 8 is an explanatory view showing a light distribution pattern for low beam having an oblique cutoff line and a horizontal cutoff line.
Figure 9:
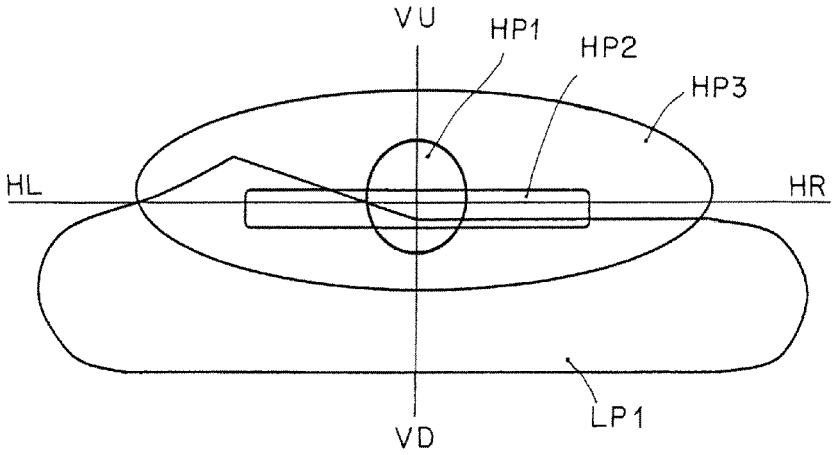
FIG. 9 is an explanatory view showing a light distribution pattern for high beam.

As shown in FIG. 5 and FIG. 6, a height H1 of a respective one of the upside gear portion 17U and the lower gear portion 17D on each end part of the rack 14 is greater than in comparison with a height H2 of a respective one of the upside gear portion 17U and the downside gear portion 17D at the intermediate part of the rack 14. The first location in which the upside movable reflector 4U and the downside movable reflector 4D respectively stop is a location in which the upside pinion 15U and the downside pinion 15D respectively engage with the upside gear portion 17U and the downside gear portion 17D, a respective one of which is one end part (a right end part) of the rack 14. The second location in which the upside movable reflector 4U and the downside movable reflector 4D respectively stop is a location in which the upside pinion 15U and the downside pinion 15D respectively engage with the upside gear portion 17U and the downside gear portion 17D, a respective one of which is one end part (a left end part) of the rack 14.

At the driving force transmission mechanism 6, a stopper adapted to position the upside movable reflector 4U and the downside movable reflector 4D in the first location and a stopper adapted to position the upside movable reflector 4U and the downside movable reflector 4D in the second location are respectively provided.

Description of Functions of First Embodiment

The vehicle headlamp 1 in the first embodiment is made of the constituent elements as described above, and hereinafter, its related functions will be described.

Figure 3:
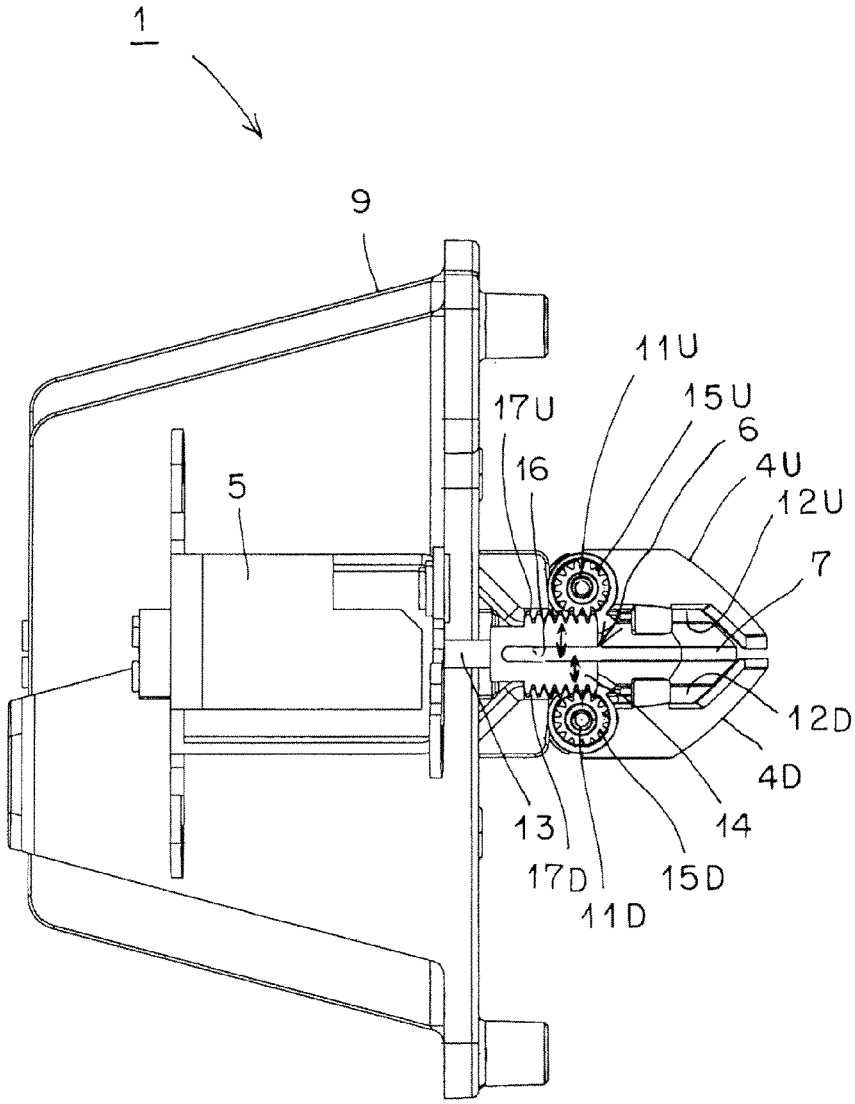
FIG. 3 is a side view showing an upside movable reflector and a downside movable reflector that are positioned in a first location (a side view showing a state in which a fixed reflector is removed)

First, the upside movable reflector 4U and the downside movable reflector 4D are positioned in the first location (the position in the state shown in FIG. 1 and FIG. 3). In other words, if power supply to the solenoid 5 is interrupted, the upside movable reflector 4U and the downside movable reflector 4D are positioned in the first location due to a function of a spring and due to a function of a stopper, although not shown. In addition, the upside pinion 15U and the downside pinion 15D respectively engage with the upside gear portion 17U and the downside gear portion 17D, a respective one of which is greater in height H1 at one end part (a right end part) of the rack 14. At this time, the upside semiconductor-type light source 2U and the downside semiconductor-type light source 2D are caused to illuminate and emit light. The light is then radiated from the upside semiconductor-type light source 2U and the downside semiconductor-type light source 2D.

A fraction of the light is shaded by means of the upside movable reflector 4U and the downside movable reflector 4D.

The remaining light is reflected on a reflection surface for low beam of the upside reflection surface 10U and the downside reflection surface 10D of the fixed reflector 3. The thus reflected light is emitted forward of a vehicle as a light distribution pattern for low beam LP shown in FIG. 8.

Figure 4:
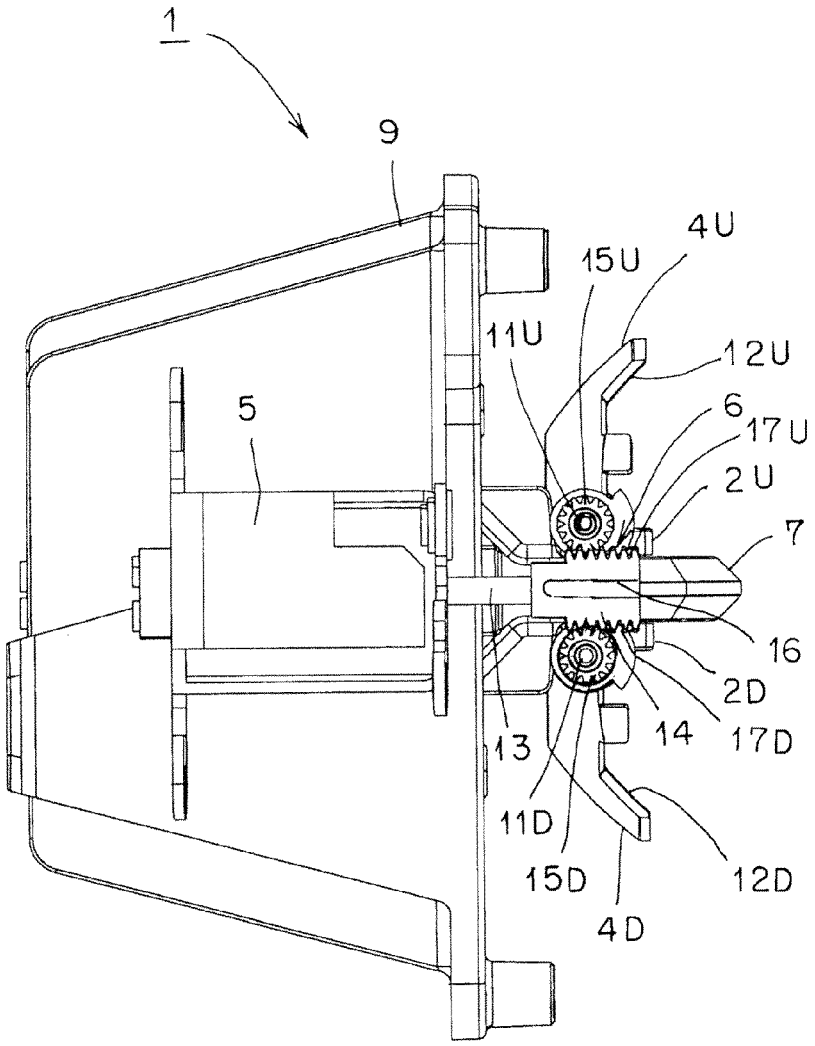
FIG. 4 is a side view showing an upside movable reflector and a downside movable reflector that are positioned in a second location (a side view showing a state in which a fixed reflector is removed)

Next, the upside movable reflector 4U and the downside movable reflector 4D are positioned in the second location (the position in the state shown in FIG. 4). In other words, when power is supplied to the solenoid 5 and then the solenoid 5 is driven, the rack 14 moves forward from the first location to the second location via the plunger 13. Then, the upside pinion 15U and the downside pinion 15D rotate while the circular gear portions respectively engage with the upside gear portion 17U and the downside gear portion 17D that are formed in an arc shape of the rack 14. In this manner, a driving force of the solenoid 5 is converted from a linear motion to a rotational motion and then the converted driving force is transmitted to the upside movable reflector 4U and the downside movable reflector 4D, via the rack 14 and a respective one of the upper pinion 15U and the downside pinion 15D of the driving force transmission mechanism 6. As a result, the upside movable reflector 4U and the downside movable reflector 4D synchronously rotate from the first location to the second location, and are positioned in the second location due to a function of a stopper, although not shown. In addition, the upside pinion 15U and the downside pinion 15D respectively engage with the upside gear portion 1U and the downside gear portion 17D, a respective one of which is greater in height H1 at the other end part (the left end part) of the rack 14. At this time, the upside semiconductor-type light source 2U and the downside semiconductor-type light source 2D are caused to illuminate and emit light. The light is then radiated from the upside semiconductor-type light source 2U and the downside semiconductor-type light source 2D.

The light is reflected on the upper reflection surface 12U of the upside movable reflector 4U and the downside reflection surface 12D of the downside movable reflector 4D. In addition, the remaining light that has not been incident to the upper reflection surface 12U of the upside movable reflector 4U and the downside reflection surface 12D of the downside movable reflector 4D is reflected on the upside reflection surface 10U and the lower reflection surface 10D of the fixed reflector 3. The thus reflected light is emitted forward of a vehicle as light distribution patterns for high beams HP1, HP2, HP3, and LP1 shown in FIG. 9.

Here, if a temperature change due to turning on or off the upside semiconductor-type light source 2U and the downside semiconductor-type light source 2D, due to power supply to the solenoid 5 or interruption of such power supply, or due to an ambient or environmental temperature change, the rack 14 and a respective one of the upside pinion 15U and the downside pinion 15D thermally expand, a load between the rack 14 and a respective one of the upside pinion 15U and the downside pinion 15D increases, and in order to absorb an influence due to such an increased load, the rack 14 is elastically deformed in a direction crossing the slit 16. In addition, the rack 14 and a respective one of the upside pinion 15U and the downside pinion 15D thermally shrink, a backlash between the rack 14 and a respective one of the upside pinion 15U and the downside pinion 15D increases, and in order to absorb an influence due to such an increased backlash, the rack 14 is elastically deformed in the direction crossing the slit 16.

When the upside movable reflector 4U and the downside movable reflector 4D are positioned in a location other than the stop location between the first location and the second location, in other words, when the upside movable reflector 4U and the downside movable reflector 4D rotatably moves between the first location and the second location, the upside pinion 15U and the downside pinion 15D respectively engage with the upside gear portion 17U and the downside gear portion 17D, a respective one of which is smaller in height H2 at the immediate part of the rack 14.

In addition, even in a case where the rack 14 rotates around the fixed center O with respect to the solenoid 5 (the center axis of the plunge 13) due to a vibration or actuation load at the time of, or subsequently to, assembling of the rack 14, the upside pinion 15U, and the downside pinion 15D of the driving force transmission mechanism 6, the upside gear portion 17U and the downside gear portion 17D that are formed in an arc shape of the rack 14 and the circular gear portions of the upside pinion 15U or the circular gear portion of the downside pinion 15D engage with each other in a predetermined state (condition). In addition, the gear portions 17U and 17D of the rack 14 with which the pinions 15U and 15D engage are fowled in the shape of an arc that is a part of a circle around the fixed center O with respect to the solenoid 5 of the rack 14. As a result, the present invention is capable of stabilizing an engagement state (condition) between the rack 14 and a respective one of the pinions 15U and 15D of the driving force transmission mechanism 6.

Description of Advantageous Effects of First Embodiment

The vehicle headlamp 1 in the first embodiment is made of the constituent elements and functions, as described above, and hereinafter, its related advantageous effects will be described.

According to the vehicle headlamp 1 in the first embodiment, the rack 14 is a rack with its elastically deformable structure; and therefore, an influence of thermal expansion or shrinkage of the rack 14, the upside pinion 15U, and the downside pinion 15D can be absorbed, and as a result, a load between the rack 14 and a respective one of the upside pinion 15U and the downside pinion 15D of the driving force transmission mechanism 6 can be maintained at its required minimum level, and the related positional precision in stop location of the upside movable reflector 4U and the downside movable reflector 4D can be maintained at higher precision. In other words, in a state in which a backlash is set to "0", the rack 14, the upside pinion 15U, and the downside pinion 15D thermally expand, a load between the rack 14 and a respective one of the upside pinion 15U and the downside pinion 15D increases, and in order to absorb an influence due to such an increased load, the rack 14 is elastically deformed to thereby absorb an influence in thermal expansion; and therefore, a load between the rack 14 and a respective one of the upside pinion 15U and the downside pinion 15D can be maintained at its required minimum level. In this manner, downsizing of the solenoid 5 or reduction of costs, mass, or power consumption can be achieved.

In addition, according to the vehicle headlamp 1 in the first embodiment, when the upside movable reflector 4U and the downside movable reflector 4D are positioned in a stop location as the first location, the upside pinion 15U and the downside pinion 15D respectively engage with the upside gear portion 17U and the downside gear portion 17D, a respective one of which is greater in height H1 at one end part (the right end part) of the rack 14, and when the upside movable reflector 4U and the downside movable reflector 4D are positioned in a stop location as the second location, the upside pinion 15U and the downside pinion 15D respectively engage with the upside gear portion 17U and the downside gear portion 17D, a respective one of which is greater in height H1 at the other end part (the left end part) of the rack 14, and further, when the upside movable reflector 4U and the downside movable reflector 4D are positioned in a location other than the stop location between of the first and second locations (in other words, when the upside movable reflector 4U and the downside movable reflector 4D rotatably moves between the first location and the second location), the upside pinion 15U and the downside pinion 15D respectively engage with the upside gear portion 17U and the downside gear portion 17D, a respective one of which is smaller in height H2 at the intermediate part of the rack 14. As a result, a load between the rack 14 and a respective one of the upside pinion 15U and the downside pinion 15D of the driving force transmission mechanism 6 can be maintained at its required minimum level, and the related positional precision in stop location of the upside movable reflector 4U and the downside movable reflector 4D can be maintained at high precision. In other words, in a state in which a backlash is set to "0" between a respective one of the upside pinion 15U and the downside pinion 15D and a respective one of the upside gear portion 17U and the downside gear portion 17D, a respective one of which is greater in height H1 of the rack 14, even if the rack 14 and a respective one of the upside pinion 15U and the downside pinion 15D thermally expand, a load between a respective one of the upside pinion 15U and the downside pinion 15U and a respective one of which the upside gear portion 17U and the downside gear portion 17D which is smaller in height H2 of the rack 14 can be maintained at its required minimum level. In this manner, downsizing of the solenoid 5 and reduction of costs, mass, or power consumption can be achieved.

On the other hand, the rack 14 and a respective one of the upside pinion 15U and the downside pinion 15D thermally shrink, a backlash between the rack 14 and a respective one of the upside pinion 15U and the downside pinion 15D increases, and in order to absorb an influence due to such an increased backlash, the rack 14 is elastically deformed to thereby absorb an influence of thermal shrinkage; and therefore, the backlash can be maintained in a state of "0", and its related positional precision can be maintained at high precision.

More specifically, in a state in which a backlash is provided between a respective one of the upside pinion 15U and the downside pinion 15D and a respective one of the upside gear portion 17U and the downside gear portion 17D which is smaller in height H2 of the rack 14, even if the rack 14 and a respective one of the upside pinion 15U and the downside pinion 15D thermally shrink, a backlash between a respective one of the upside pinion 15U and the downside pinion 15D and a respective one of the upside gear portion 17U and the downside gear portion 17D which is greater in height H1 of the rack 14 can be maintained in a state of "0" or in a state close to "0", and its related positional precision can be maintained at high precision.

In this manner, according to the vehicle headlamp 1 in the first embodiment, a load between the rack 14 and a respective one of the upside pinion 15U and the downside pinion 15D of the driving force transmission mechanism 6 can be maintained at its required minimum level, thus making it possible to perform switching between a light distribution pattern for low beam LP and a respective one of light distribution patterns for high beams HP1, HP2, HP3, and LP1 smoothly and within a short period of time in comparison with that of the conventional technique. On the other hand, the positional precision in stop location of the upside movable reflector 4U and the downside movable reflector 4D can be maintained at high precision, thus making it possible to improve light distribution precision of the light distribution pattern for low beam LP and the light distribution patterns for high beams HP1, HP2, HP3, and LP1 in comparison with that of the conventional technique. Moreover, there is no need to selectively employ an expensive material with its comparatively small linear expansion coefficient (thermal expandability) as a material for the rack 14 and a respective one of the upside pinion 15U and the downside pinion 15D of the driving force transmission mechanism 6, and manufacturing costs can be reduced accordingly.

According to the vehicle headlamp 1 in the first embodiment, a slit 16 which is (substantially) in parallel to a pitch line is provided in the rack 14; and therefore, its related structure is simplified. Moreover, the rack can be reliably elastically deformed in response to thermal expansion or shrinkage; and therefore, thermal expansion or shrinkage can be reliably absorbed, a load between the rack 14 and a respective one of the upside pinion 15U and the downside pinion 15D of the driving force transmission mechanism 6 can be maintained at its required minimum level, and its related positional precision can be maintained at high precision.

According to the vehicle headlamp 1 in the first embodiment, the upside gear portion 17U and the downside gear portion 17D of the rack 14, with which the circular gear portion of the upside pinion 15U and the circular gear potion of the downside pinion 15D engage, are formed in the shape of an arc that is a part of a circle around a fixed center O with respect to the solenoid 5 of the rack 14 (the center axis of the plunger 13). As a result, even in a case where the rack 14 rotates around the fixed center O with respect to the solenoid 5 (the center axis of the plunger 13) due to a vibration or actuation load or the like at the time of, or subsequent to, assembling of the rack 14 and a respective one of the upside pinion 15U and the downside pinion 15D of the driving force transmission mechanism 6, an engagement state (condition) between a respective one of the upside gear portion 17U and the downside gear portion 17D formed in the shape of an arc of the rack 14 and a respective one of the circular gear portion of the upside pinion 15U and the circular gear portion of the downside pinion 15D is stabilized. Thus, there is no need to upsize the solenoid 5 due to an increase in workload between the rack 14 and a respective one of the upside pinion 15U and the downside pinion 15D of the driving force transmission mechanism 6; and therefore, manufacturing costs, mass, or power consumption can be restrained at its required minimum level, since there is no need to provide a mechanism for preventing rotation of the rack 14.

Description of Second Embodiment

Figure 10:
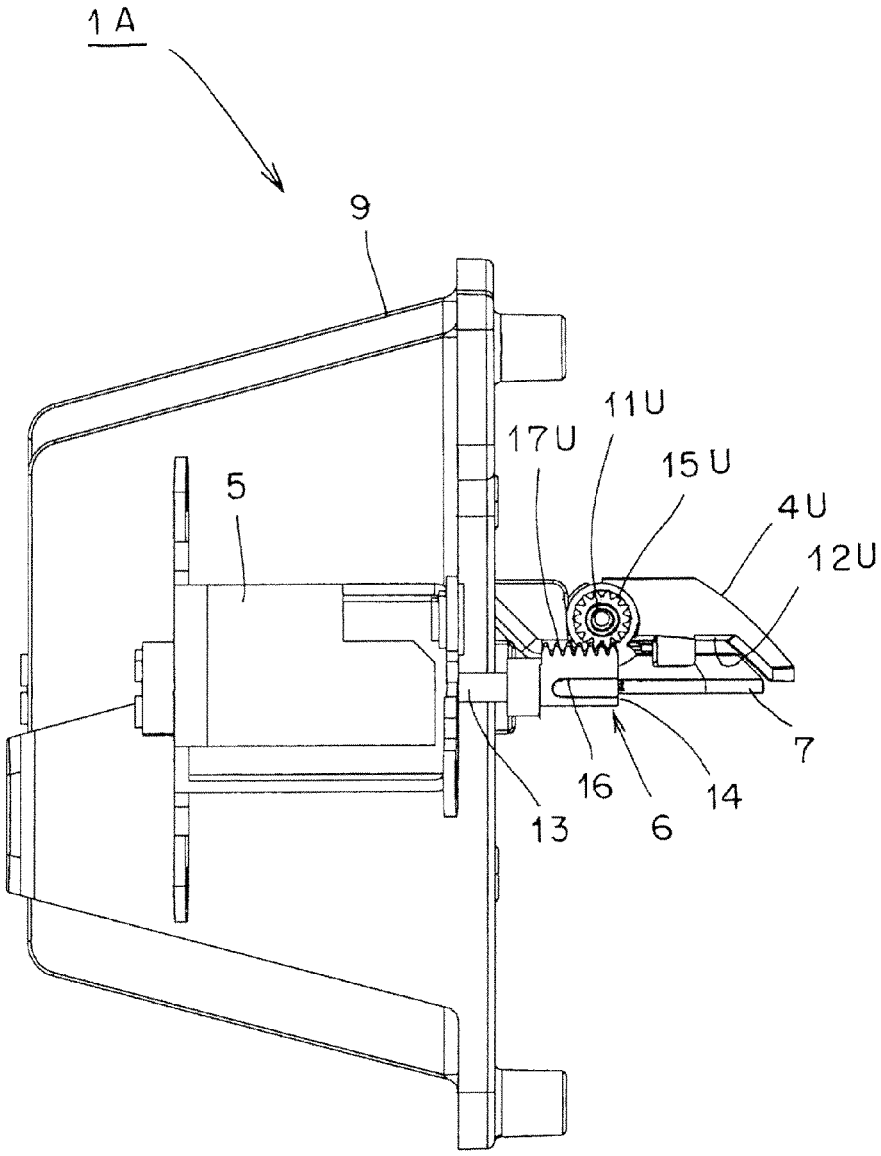
FIG. 10 is a side view showing a lamp unit in a vehicle headlamp according to a second embodiment of the present invention (a side view showing an upside movable reflector that is positioned in a first location in a state in which a fixed reflector is removed)

FIG. 10 shows a vehicle headlamp according to a second embodiment of the present invention. Hereinafter, the vehicle headlamp in the second embodiment will be described. In the figure, same constituent elements in the FIG. 1 to FIG. 9 are designated by same reference numerals.

The vehicle headlamp 1 in the first embodiment is provided with: an upside semiconductor-type light source 2U and a downside semiconductor-type light source 2D; an upside movable reflector 4U and a downside movable reflector 4D; an upside reflection surface 10U and a downside reflection surface 10D of a fixed reflector 3; an upside rotary shaft 11U and a downside rotary shaft 11D; an upside reflection surface 12U of the upside movable reflector 4U and a downside reflection surface 12D of the downside movable reflector 4D; an upside pinion 15U and a downside pinion 15D; and an upside gear portion 17U and a downside gear portion 17D that are formed in an arc shape of a rack 14. In other words, this vehicle headlamp is provided with an upside unit and a downside unit. On the other hand, a vehicle headlamp 1A in the second embodiment is provided with: an upside semiconductor-type reflection surface (not shown); an upside movable reflector 4U; an upside reflection surface (not shown) of a fixed reflector (not shown); an upside rotary shaft 11U; an upside reflection surface 12U of the upside movable reflector 4U; an upside pinion 15U; and an upside gear portion 17U formed in an arc shape of a rack 14. In other words, this vehicle headlamp is provided with only an upside unit.

The vehicle headlamp 1A in the second embodiment is capable of achieving functions and advantageous effects that are substantially identical to those of the vehicle headlamp 1 in the first embodiment. In particular, the vehicle headlamp 1A in the second embodiment is capable of halving some of the constituent elements in size; and therefore, the number of parts can be reduced, and the number of assembling steps can also be reduced, making it possible to reduce its related manufacturing costs accordingly. In this manner, the vehicle headlamp 1A in the second embodiment is optimal in a case where a light quantity (a light output) of a semiconductor-type light source is large.

Description of Third Embodiment

Figure 11:
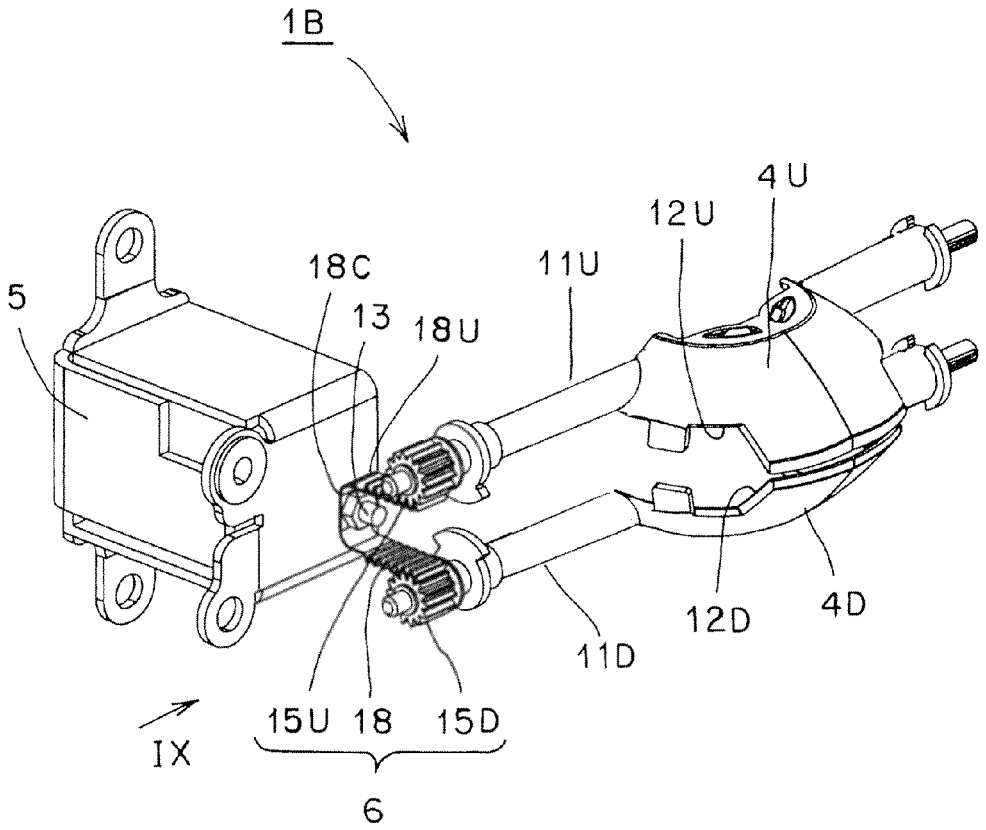
FIG. 11 is a perspective view showing the essential portions (a driving source, a driving force transmission mechanism, and a upside movable reflector and a downside movable reflector that are positioned in the first location) of a vehicle headlamp according to a third embodiment of the present invention.
Figure 12:
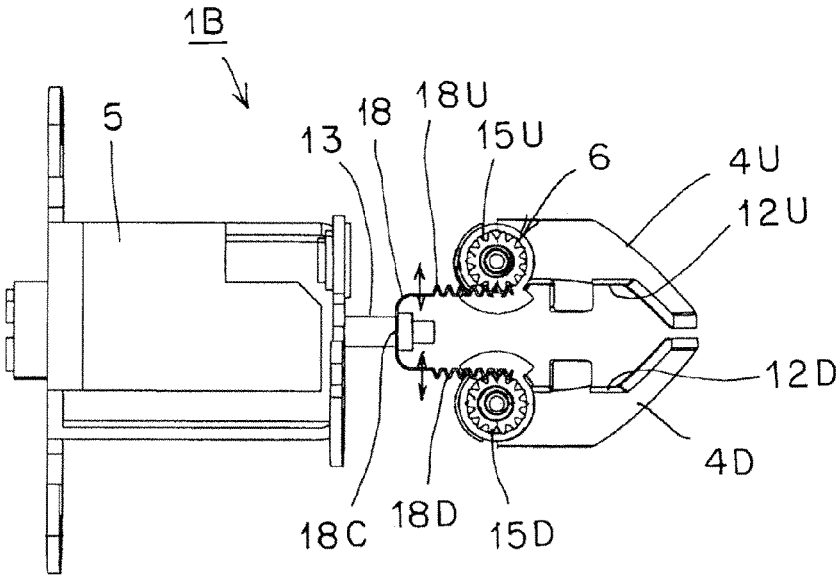
FIG. 12 is a view taken along the direction as indicated by the arrow the line IX in FIG. 11 (a side view of the essential portions)

FIG. 11 and FIG. 12 each show a vehicle headlamp according to a third embodiment of the present invention. Hereinafter, the vehicle headlamp in the third embodiment will be described. In the figure, same constituent elements in FIG. 1 to FIG. 10 are designated by same reference numerals.

According to the vehicle headlamps 1 and 1A in the first and second embodiments, a slit 16 that is in parallel to a pitch line is provided in an intermediate part of a rack 14 that is made of a metal member. On the other hand, a vehicle headlamp 1B in the third embodiment uses a rack 18 that is made of a plate member, a plate spring in this example. The rack 18 is made of an upside plate member 18U, a downside plate member 18D, and a center plate member 18C. The rack 18 is a rack in which the upside plate member 18U and the downside plate member 18D are elastically deformed in the direction crossing the upside plate member 18U and the downside plate portion 18D (in the direction as indicated by the arrow drawn by solid line in FIG. 12).

An upside gear portion and a downside gear portion are respectively provided at the upside plate member 18U and the downside plate member 18D. An upside pinion 15U and a downside pinion 15D respectively engage with the upside plate member (upside gear portion) 18U and the downside plate member (downside gear portion) 18D. The center plate member 18C is fixed to a plunger 13 of a solenoid 5.

The vehicle headlamp 1B in the third embodiment is capable of achieving functions and advantageous effects that are substantially identical to those of the vehicle headlamps 1 and 1A in the first and second embodiments. In particular, according to the vehicle headlamp 1B in the third embodiment, the rack 18 is made of plate members (plate springs in this example) 18U, 18D, and 18C, and the upside plate member 18U and the downside plate member 18D are elastically deformed in the direction crossing the upside plate member 18U and the downside plate portion 18D; and therefore, its related structure is simplified. Moreover, these plate members are reliably elastically deformed in response to thermal expansion or shrinkage; and therefore, thermal expansion or shrinkage can be reliably absorbed, a load between the rack 18 and a respective one of the inions 15U and 15D of the driving force transmission mechanism 6 can be maintained at its required minimum level, and its related positional precision can be maintained at high precision.

Description of Fourth Embodiment

Figure 13:
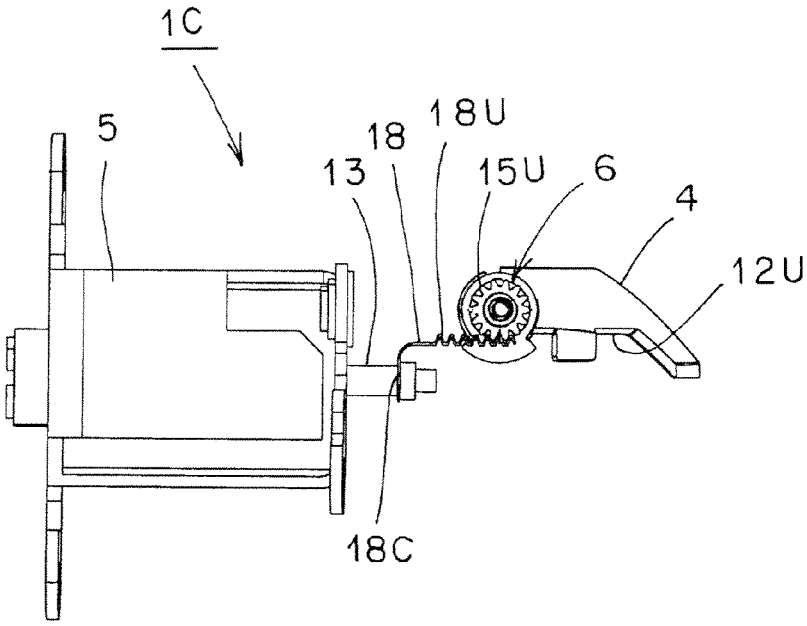
FIG. 13 is a perspective view showing the essential portions (a driving source, a driving force transmission mechanism, and a upside movable reflector and a downside movable reflector that are positioned in the first location) of a vehicle headlamp according to a fourth embodiment of the present invention.

FIG. 13 shows a vehicle headlamp according to a fourth embodiment of the present invention. Hereinafter, the vehicle headlamp in the fourth embodiment will be described. In the figure, same constituent elements in FIG. 1 to FIG. 12 are designated by same reference numerals.

The vehicle headlamps 1 and 1B in the first to third embodiments each are provided with: an upside semiconductor-type light source 2U and a downside semiconductor-type light source 2D; an upside movable reflector 4U and a downside movable reflector 4D; an upside reflection surface 10U and a downside reflection surface 10D of a fixed reflector 3; an upside rotary shaft 11U and a downside rotary shaft 11D; an upside reflection surface 12U of the upside movable reflector 4U and a downside reflection surface 12D of the downside movable reflector 4D; an upside pinion 15U and a lower pinion 15D; and upside gear portions 17U and 18U and downside gear portions 17D and 18D of a rack 14. In other words, these headlamps each are provided with an upside unit and a downside unit. On the other hand, a vehicle headlamp 1C in the fourth embodiment is provided with: an upside semiconductor-type light source (not shown); an upside movable reflector 4U; an upside reflection surface (not shown) of a fixed reflector (not shown); an upside rotary shaft 11U; an upside reflection surface 12U of an upside movable reflector 4U; an upside pinion 15U; and upside gear portions 17U and 18U of racks 14 and 18. In other words, this vehicle headlamp is provided with only an upside unit.

The vehicle headlamp 1C in the fourth embodiment is capable of achieving functions and advantageous effects that are substantially identical to those of the vehicle headlamps 1, 1A, and 1B in the first to third embodiments. In particular, as is the case with the vehicle headlamp 1A in the second embodiment, the vehicle headlamp 1C in the fourth embodiment is capable of halving some of the constituent elements in size; and therefore, the number of parts can be reduced, and the number of assembly steps can also be reduced, making it possible to reduce its related manufacturing costs accordingly. In this manner, as is the case with the vehicle headlamp 1A in the second embodiment, the vehicle headlamp 1C in the fourth embodiment is optimal in a case where a light quantity (light output) of a semiconductor-type light source is large.

Description of Fifth Embodiment

Figure 14:
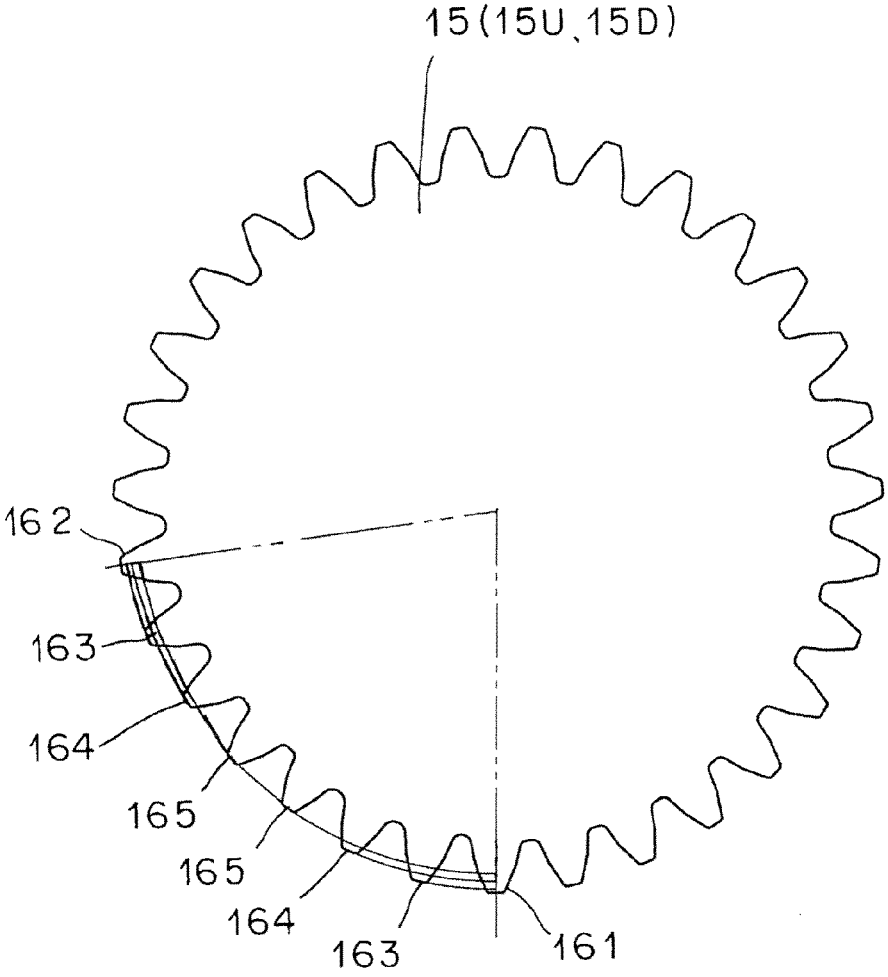
FIG. 14 is an explanatory view showing a pinion according to a vehicle headlamp according to a fifth embodiment of the present invention.
Figure 15:
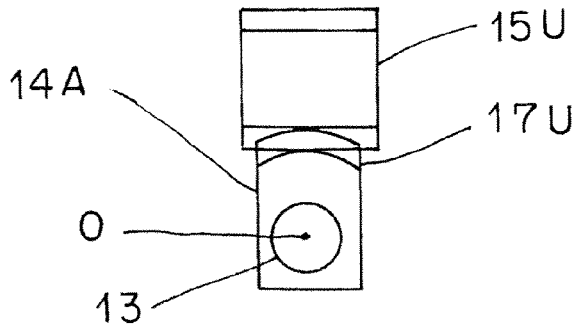
FIG. 15 is an explanatory view showing an engagement state between a gear portion of a rack and a gear portion of the pinion.

FIG. 14 shows a vehicle headlamp according to a fifth embodiment of the present invention. Hereinafter, the vehicle headlamp in the fifth embodiment will be described. In the figure same constituent elements in FIG. 1 to FIG. 13 are designated by same reference numerals.

According to the vehicle headlamp 1 in the first embodiment, the height H1 of a respective one of the upside gear portion 17U and the downside gear portion 17D at each end part of the rack 14 is increased in comparison with the height H2 of the upside gear portion 17U and the downside gear portion 17D at the intermediate part of the rack 14. On the other hand, according to the vehicle headlamp in the second embodiment, among the gear portions of pinions 15 (a upside pinion 15U and a downside pinion 15D), the height of a gear portion 161 engaging with gear portions (an upside gear portion 17U and a downside gear portion 17D) at one end part of the rack 14 and a gear portion 162 engaging with gear portions (an upside gear portion 17U and a downside gear portion 17D) at an intermediate part of the rack 14 is greater in comparison with a height of gear portions 163, 164, and 165 engaging with gear portions (an upside gear portion 17U and a downside gear portion 17D) at the intermediate part of the rack 14. It is to be noted that the first location in which the upside movable reflector 4U and the downside movable reflector 4D stop is a location in which the gear portion 161 of the pinions 15 (the upside pinion 15U and the downside pinion 15D) engages with the gear portions (the upside gear portion 17U and the downside gear portion 17D) at one end part of the rack 14, and that the second location in which the upside movable reflector 4U and the downside movable reflector 4D stop is a location in which the pinions 15 (the upside pinion 15U and the downside pinion 15D) engages with the gear portions (the upside gear portion 17U and the downside gear portion 17D) of the rack 14.

The vehicle headlamp in the fifth embodiment is capable of achieving functions and advantageous effects that are substantially identical to those of the vehicle headlamp 1 in the first embodiment.

Description of Sixth Embodiment

Figure 16:
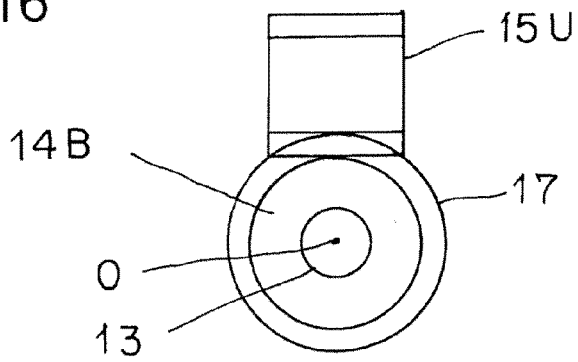
FIG. 16 is an explanatory view showing an engagement state of a gear portion of a rack and a gear portion of a pinion according to a vehicle headlamp according to a sixth embodiment of the present invention.

FIG. 16 shows a vehicle headlamp according to a sixth embodiment of the present invention. Hereinafter, the vehicle headlamp in the third embodiment will be described. In the figure, same constituent elements in FIG. 1 to FIG. 15 are designated by same reference numerals.

The vehicle headlamp 1A in the second embodiment, an upside gear portion 17U of a rack 14A is formed in the shape of an arc which is a part of a circular. According to the vehicle headlamp 1A in the sixth embodiment, a gear portion 17 of a rack 14B is formed in a circular shape.

The vehicle headlamp in the sixth embodiment is capable of achieving functions and advantageous effects that are substantially identical to those of the vehicle headlamp 1A in the second embodiment.

Description of Seventh Embodiment

Figure 17:
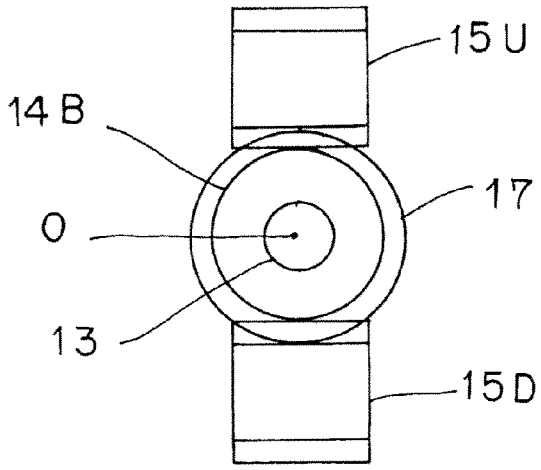
FIG. 17 is an explanatory view showing an engagement state of a gear portion of a rack and a gear portion of a pinion according to a vehicle headlamp according to a seventh embodiment of the present invention.

FIG. 17 shows a vehicle headlamp according to a seventh embodiment of the present invention. Hereinafter, the vehicle headlamp in the seventh embodiment will be described. In the figure, same constituent elements shown in FIG. 1 to FIG. 16 are designated by same reference numerals.

According to the vehicle headlamp 1 in the first embodiment, an upside gear portion 17U and a downside gear portion 17D of a rack 14 are formed in the shape of an arc which is a part of a circle. According to the vehicle headlamp in the seventh embodiment, a gear portion 17 of a rack 14B is formed in a circular shape.

The vehicle headlamp in the seventh embodiment is capable of achieving functions and advantageous effects that are substantially identical to those of the vehicle headlamp 1 in the first embodiment.

Description of Eighth Embodiment

Figure 18:
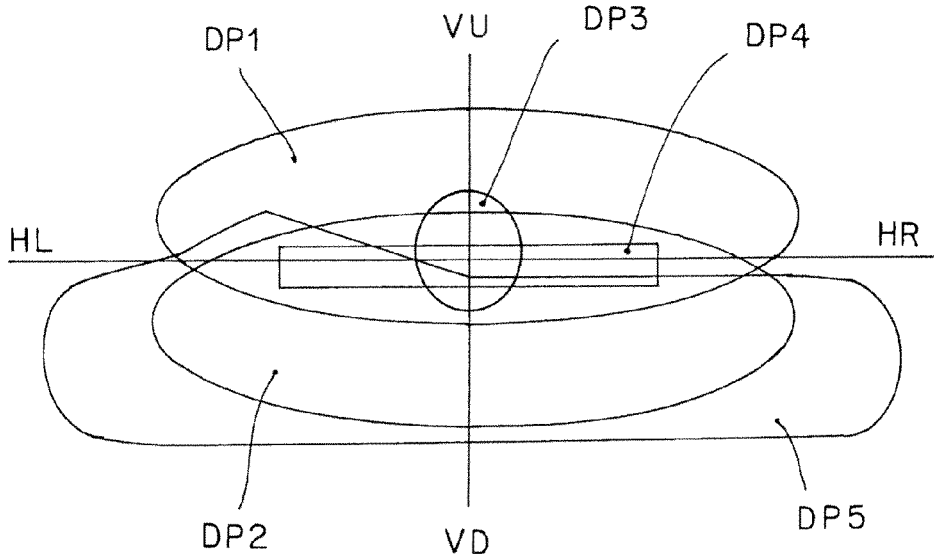
FIG. 18 is an explanatory view showing a vehicle headlamp according to an eighth embodiment of the present invention, and showing a light distribution pattern for day time running light.

FIG. 18 shows a vehicle headlamp according to an eighth embodiment of the present invention. Hereinafter, the vehicle headlamp in the eighth embodiment will be described. In the figure, same constituent elements in FIG. 1 to FIG. 13 are designated by same reference numerals.

According to the vehicle headlamps 1, 1A, 1B, and 1C in the first to seventh embodiments, there can be obtained a light distribution pattern for low beam LP and light distribution patterns for high beams HP1, HP2, HP3, and LP1. On the other hand, according to the vehicle headlamp in the eighth embodiment, when movable reflectors 4U and 4D are positioned in the first location, the light distribution pattern for low beam LP can be obtained; when the movable reflectors 4U and 4D are positioned in the second location, the light distribution patterns for high beams HP1, HP2, HP3, and LP1 can be obtained; and when the movable reflectors 4U and 4D are positioned in the third location, light distribution patterns for daytime running light DP1, DP2, DP3, DP4, and DP5 can be obtained as shown in FIG. 18.

Descriptions of Examples Other than First to Eighth Embodiments

In the first to eighth embodiments, a light distribution pattern for low beam LP has been described as a first light distribution pattern. However, in the present invention, as the first light distribution pattern, there may be employed a light distribution pattern other than the light distribution pattern for low beams LP, for example, a light distribution pattern having an oblique cutoff line on a cruising lane side and having a horizontal cutoff line on an opposite lane side around an elbow point, such as a light distribution pattern for expressway or a light distribution pattern for fog lamp.

In addition, in the first to eighth embodiments, the vehicle headlamp 1 for left side cruising lane has been described. However, the present invention can be applied to a vehicle headlamp for right side cruising lane as well.

Further, in the first to eighth embodiments, a vehicle headlamp has been provided with an upside unit and a downside unit have been provided, or alternatively, a vehicle headlamp has been provided with only an upside unit. However, in the present invention, there may be a vehicle headlamp provided with only a downside unit, a vehicle headlamp provided with a left side unit and a right side unit, a vehicle headlamp provided with only a left side unit, a vehicle headlamp provided with only a right side unit or the like.

Furthermore, in the first to eighth embodiments, a solenoid 5 has been used as a driving source. However, in the present invention, a driving source other than the solenoid 5, for example, a motor may be used as a driving source. In this case, a mechanism adapted to convert a rotational motion of a motor to a linear motion of racks 14, 14A, 14B, and 18 is needed.

Still furthermore, in the first to eighth embodiments, as stop locations, there have been employed two locations made of a first location and a second location and three locations made of the first location, the second location, and a third location. However, in the present invention, four or more locations may be employed as the stop locations.

Yet furthermore, in the first, second, third, and fourth embodiments, two light distribution patterns have been obtained, and in the fifth embodiment, three light distribution patterns have been obtained. However, in the present invention, four or more light distribution patterns may be obtained.

Moreover, in the first embodiment, gear portions 17U and 17D, a respective one of which is greater in height H1, have been provided at both end parts of a rack 14. However, in the present invention, a gear portion which is greater in height H1 may be provided at a site other than each end part of a rack 14, for example, at a center part.

What is claimed is:

1. A vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is configured to reflect light from the semiconductor-type light source;

a movable reflector having a reflection surface that is configured to reflect the light from the semiconductor-type light source, the movable reflector being rotatably disposed at least between a first location and a second location;

a driving source; and a driving force transmission mechanism that is provided between the driving source and the movable reflector, and is configured to transmit a driving force of the driving source to the movable reflector to thereby transfer the movable reflector at least between the first location and the second location, wherein the driving force transmission mechanism is made of a rack having an elastically deformable structure and a pinion engaging with the rack.

2. The vehicle headlamp according to claim 1, wherein the rack is a rack having an elastically deformable structure in which a slit that is in parallel to a pitch line is provided, and which is elastically deformable in a direction crossing the slit.

3. The vehicle headlamp according to claim 1, wherein the rack is a rack having an elastically deformable structure which is made of a plate member, and is elastically deformable in a direction crossing the plate member.

4. A vehicle headlamp for switching at least a first light distribution pattern and a second light distribution pattern from each other to thereby emit light forward of a vehicle, the vehicle headlamp comprising:

a semiconductor-type light source;

a fixed reflector having a reflection surface that is configured to reflect light from the semiconductor-type light source;

a movable reflector having a reflection surface that is configured to reflect the light from the semiconductor-type light source, the movable reflector being rotatably disposed at least between a first location and a second location;

a driving source; and a driving force transmission mechanism that is provided between the driving source and the movable reflector, and is configured to transmit a driving force of the driving source to the movable reflector to thereby transfer the movable reflector at least between the first location and the second location, wherein the driving force transmission mechanism is made of a rack having an elastically deformable structure and a pinion engaging with the rack, and a height of at least one of a gear portion of the rack and a gear portion of the pinion when the movable reflector is positioned in at least a stop location between a first location and a second location is greater in comparison with a height of at least one of a gear portion of the rack and a gear portion of the pinion when the movable reflector is positioned in a location other than the stop location between the first location and the second location.

5. The vehicle headlamp according to claim 4, wherein a height of a gear portion at each end part of the rack is greater in comparison with a height of a gear portion at an intermediate part of the rack, a first location in which the movable reflector stops is a location in which the pinion engages with a gear portion at one end part of the rack, and a second location in which the movable reflector is a location in which the pinion engages with a gear portion at the other end part of the rack.

6. The vehicle headlamp according to claim 4, wherein the first location in which the movable reflector stops is a location in which the pinion engages with the gear portion at one end part of the rack, the second location in which the movable reflector is a location in which the pinion engages with the gear portion at the other end part of the rack, and among the gear portions of the pinion, a height of the gear portion engaging with the gear portion at one end part of the rack and the gear portion engaging with the gear portion at the other end part of the rack is greater than a height of the gear portion engaging with the gear portion at the intermediate part of the rack.

7. A vehicle headlamp for switching at least a first light distribution pattern and a second light distribution pattern from each other to thereby emit light in a forward direction of a vehicle, the vehicle headlamp comprising:

a semiconductor-type light source;

a fixed reflector having a reflection surface that is configured to reflect light from the semiconductor-type light source;

a movable reflector having a reflection surface that is configured to reflect the light from the semiconductor-type light source, the movable reflector being rotatably disposed at least between a first location and a second location, the reflection surface of the movable reflector being a parabolic free curved surface, the movable reflector comprising a downside movable reflector and an upside movable reflector separate from the downside movable reflector;

a driving source; and a driving force transmission mechanism that is provided between the driving source and the movable reflector, and is configured to transmit a driving force of the driving source, via a plunger between the driving force and the driving force transmission mechanism, to the movable reflector to thereby transfer the movable reflector at least between the first location and the second location, wherein the driving force transmission mechanism is made of a rack that is fixed to the driving source and a pinion that is fixed to the movable reflector, and that is configured to engage with the rack, and a gear portion of the rack, with which the pinion engages, is formed in a shape of an arc that is a part of a circle around a fixed center with respect to the driving source of the rack, the driving source configured to drive the rack in the forward direction such that the downside movable reflector and the upside movable reflector synchronously rotate from the first location to the second location.

8. A vehicle headlamp for switching at least a first light distribution pattern and a second light distribution pattern from each other to thereby emit light in a forward direction of a vehicle, the vehicle headlamp comprising:

a semiconductor-type light source;

a fixed reflector having a reflection surface that is configured to reflect light from the semiconductor-type light source;

a movable reflector having a reflection surface that is configured to reflect the light from the semiconductor-type light source, the movable reflector being rotatably disposed at least between a first location and a second location, the reflection surface of the movable reflector being a parabolic free curved surface, the movable reflector comprising a downside movable reflector and an upside movable reflector separate from the downside movable reflector;

a driving source; and a driving force transmission mechanism that is provided between the driving source and the movable reflector, and is configured to transmit a driving three of the driving source, via a plunger between the driving force and the driving force transmission mechanism, to the movable reflector to thereby transfer the movable reflector at least between the first location and the second location, wherein the driving force transmission mechanism is made of a rack that is fixed to the driving source and a pinion that is fixed to the movable reflector, and that is configured to engage with the rack, and a gear portion of the rack, with which the pinion engages, is formed in a circular shape around a fixed center with respect to the driving source of the rack, the driving source configured to drive the rack in the forward direction such that the downside movable reflector and the upside movable reflector synchronously rotate from the first location to the second location.

* * * * *